US006126124A

United States Patent [19]

Wagner

[11] Patent Number: 6,126,124

[45] Date of Patent: Oct. 3, 2000

[54] REMOVABLE PERFORATED TRAY FOR COOLERS

[76] Inventor: Wolfgang Wagner, P.O. Box 1139, Tehachapi, Calif. 93561

[21] Appl. No.: 09/233,945

[22] Filed: Jan. 20, 1999

[51] Int. Cl.[7] ..... A45D 19/04

[52] U.S. Cl. ..... 248/127; 248/163.1; 248/346.01; 62/465

[58] Field of Search ..... 248/346.01, 346.11, 248/188.1, 127, 159, 158, 163.1; 62/465

[56] References Cited

U.S. PATENT DOCUMENTS

| | | | |
|---|---|---|---|
| 886,685 | 5/1908 | Eastman | 248/163 |
| 1,703,453 | 2/1929 | Parker | 248/163 |
| 2,661,567 | 12/1953 | Paege | 248/346.11 |
| 2,989,205 | 6/1961 | Yaws | 215/100.5 |
| 3,220,681 | 11/1965 | Erbert | 248/119 |
| 3,237,778 | 3/1966 | Hoodis | 211/86 |
| 4,424,687 | 1/1984 | Morgan | 62/457 |
| 5,052,184 | 10/1991 | Jarvis | 62/60 |
| 5,052,185 | 10/1991 | Spahr | 62/60 |
| 5,524,761 | 6/1996 | Wayman | 206/545 |

*Primary Examiner*—Ramon O. Ramirez
*Assistant Examiner*—Walter Landry
*Attorney, Agent, or Firm*—Goldstein & Canino

[57] ABSTRACT

A removable perforated tray for coolers including a tray portion constructed of a plurality of interconnecting horizontal and vertical ribs whereby spaces are created between interconnections of adjacent horizontal and vertical ribs. The tray portion is dimensioned for being received within an interior of a cooler. A plurality of peripheral collars extend through large openings of the tray portion inwardly of a periphery thereof. The collars each have a support leg extending outwardly thereof.

7 Claims, 2 Drawing Sheets

FIG 1
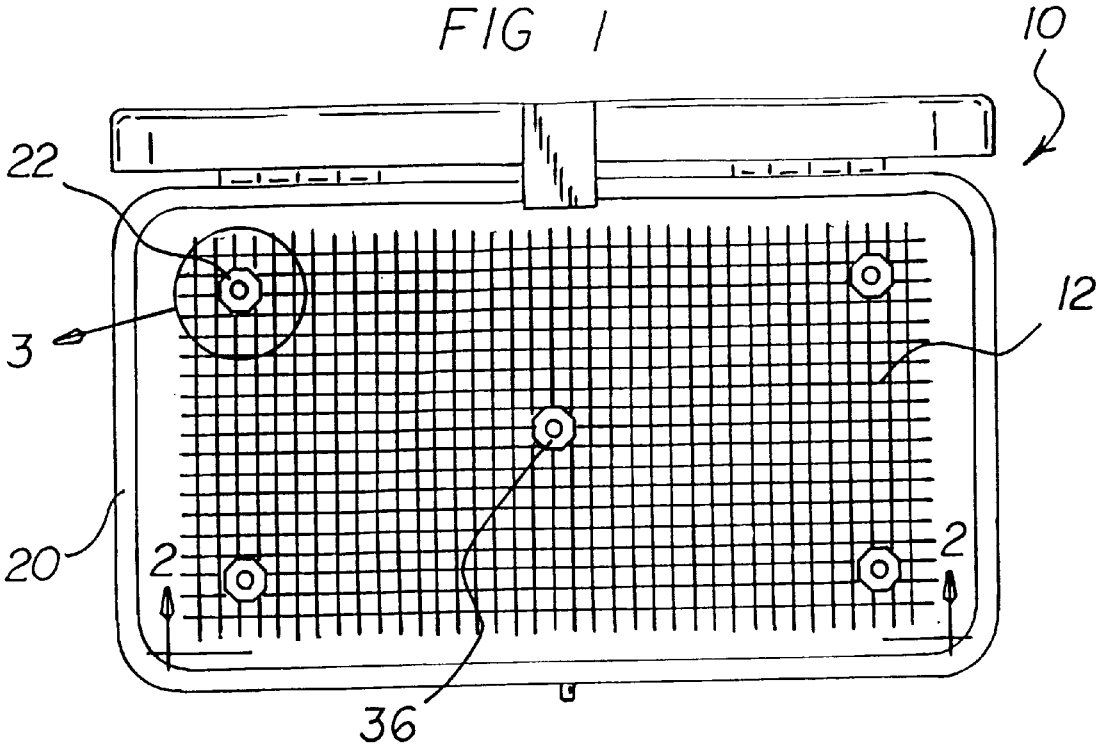
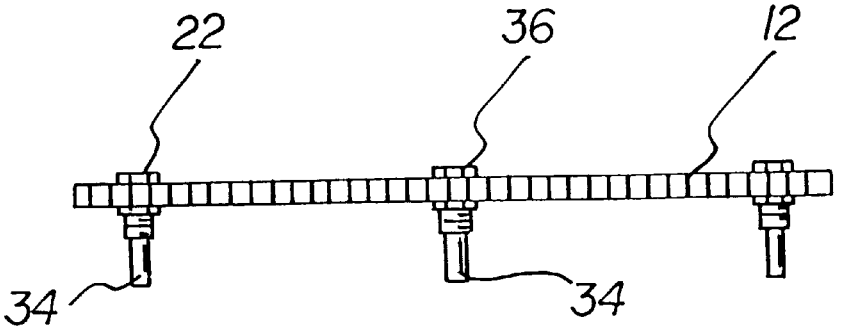
FIG 2

REMOVABLE PERFORATED TRAY FOR COOLERS

BACKGROUND OF THE INVENTION

The present invention relates to a removable perforated tray for coolers and more particularly pertains to separating food items from melted ice to prevent the food items from sitting in water.

Portable ice chests and coolers have been used for years by campers, fisherman, and the like for keeping food items and drinks cold. While these ice chests and coolers are proven to be able to maintain desired temperatures, the ice that generally container therein tends to melt. Those food items that are in contact with the ice will become soggy as the ice melts, somewhat reducing the desirabilty and freshness thereof.

Many coolers are now provided with trays that allow for the food items to be placed therein for protection against the melting of the ice. These trays do not allow for ice to be utilized therein because the same problem will occur once the ice melts.

A need exists for a tray for an ice chest or cooler that can hold food items and ice, but at the same time will not contain the water that will be created from the melting of the ice. The present invention provides the solution to this long existing need.

The use of tray and separator devices is known in the prior art. More specifically, tray and separator devices heretofore devised and utilized for the purpose of separating a cooler into sections are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,872,589 to Englehart discloses a combination insert and liner for separating a refrigerator container, such as a portable ice chest, into two or more watertight containers, to prevent sandwiches and food items from become soggy as the ice melts. The Englehart device differs from the present invention in that it includes a base and walls to provide a watertight compartment. U.S. Pat. No. 5,071,026 to Apps discloses a reusable case comprised of a shelf and divider system formed of a series of bars forming a grid-like design. The Apps device differs from the present invention in that it is used for separating multiple sized bottles for packaging. U.S. Pat. No. 5,261,561 to Hodges, Jr. discloses a device for separating a circular storage device with a removable insert. The insert is secured to an open upper end of the storage device whereas the present invention is disposed interiorly of the collar. U.S. Pat. No. 4,841,661 to Moore discloses a fisherman's combination chest including a cooler and a removable food tray. U.S. Pat. No. 5,212,902 to Moorhead discloses a container with means to separate fish and other items, such as sandwiches, with the use of two or more compartments.

While these devices fulfill their respective, particular objective and requirements, the aforementioned patents do not describe a removable perforated tray for coolers for separating food items from melted ice to prevent the food items from sitting in water.

In this respect, the removable perforated tray for coolers according to the present invention substantially departs from the conventional concepts and designs of the prior art, and in doing so provides an apparatus primarily developed for the purpose of separating food items from melted ice to prevent the food items from sitting in water.

Therefore, it can be appreciated that there exists a continuing need for new and improved removable perforated tray for coolers which can be used for separating food items from melted ice to prevent the food items from sitting in water. In this regard, the present invention substantially fulfills this need.

SUMMARY OF THE INVENTION

In the view of the foregoing disadvantages inherent in the known types of tray and separator devices now present in the prior art, the present invention provides an improved removable perforated tray for coolers. As such, the general purpose of the present invention, which will be described subsequently in greater detail, is to provide a new and improved removable perforated tray for coolers and method which has all the advantages of the prior art and none of the disadvantages.

To attain this, the present invention essentially comprises a tray portion having a generally rectangular configuration. The tray portion is defined by opposed long side edges, opposed short end edges, and four corners. The tray portion is constructed of a plurality of interconnecting horizontal and vertical ribs whereby spaces are created between interconnections of adjacent horizontal and vertical ribs. The tray portion is dimensioned for being received within an interior of a cooler. Four corner collars extend through large openings of the tray portion inwardly of the four corners thereof. The collar is defined by open upper and lower ends. The open upper ends have a peripheral flange disposed thereon. A lower portion of the collars are externally threaded for being engaged by an internally threaded washer on an underside of the tray portion. The open lower ends each have a support leg extending outwardly thereof. A central collar extends through a large opening in a central portion of the tray portion. The central collar is defined by open upper and lower ends. The open upper end has a peripheral flange disposed thereon. A lower portion of the central collar is externally threaded for being engaged by an internally threaded washer on the underside of the tray portion. The open lower end has a support leg extending outwardly thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved removable perforated tray for coolers which has all the advantages of the prior art tray and separator devices and none of the disadvantages.

It is another object of the present invention to provide a new and improved removable perforated tray for coolers which may be easily and efficiently manufactured and marketed.

It is a further object of the present invention to provide a new and improved removable perforated tray for coolers which is of durable and reliable construction.

An even further object of the present invention is to provide a new and improved removable perforated tray for coolers which is susceptible of a low cost of manufacture with regard to both materials and labor, and which accordingly is then susceptible of low prices of sale to the consuming public, thereby making such a removable perforated tray for coolers economically available to the buying public.

Even still another object of the present invention is to provide a new and improved removable perforated tray for coolers for separating food items from melted ice to prevent the food items from sitting in water.

Lastly, it is an object of the present invention to provide a new and improved removable perforated tray for coolers including a tray portion constructed of a plurality of interconnecting horizontal and vertical ribs whereby spaces are created between interconnections of adjacent horizontal and vertical ribs. The tray portion is dimensioned for being received within an interior of a cooler. A plurality of peripheral collars extend through large openings of the tray portion inwardly of a periphery thereof. The collars each have a support leg extending outwardly thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of the preferred embodiment of the removable perforate tray for coolers constructed in accordance with the principles of the present invention.

FIG. 2 is a side view of the present invention as taken along line 2—2 of FIG. 1.

The same reference numerals refer to the same parts through the various figures.

DESCRIPTION OF THE PREFERRED EMBODIMENT

Figure 3:
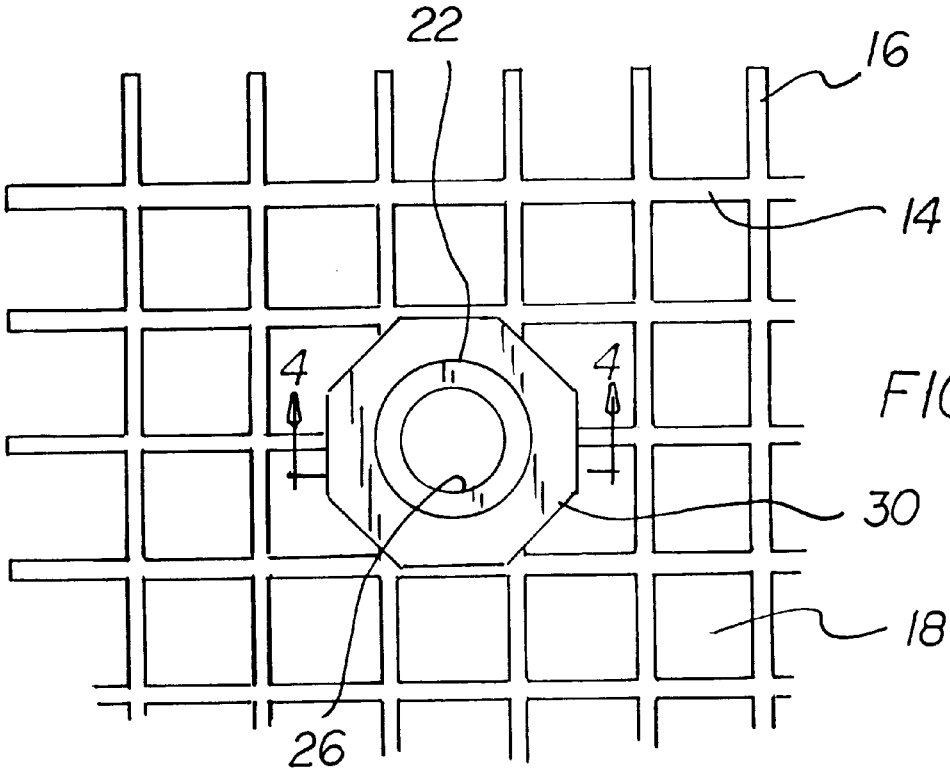
FIG. 3 is an enlarged plan view of the present invention as taken from circle 3 of FIG. 1.
Figure 4:
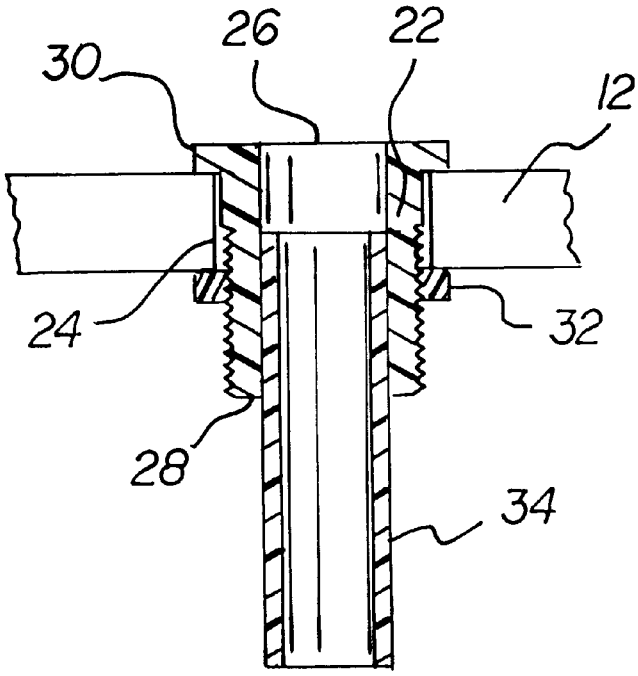
FIG. 4 is a cross-sectional view of the present invention as taken along line 4—4 of FIG. 3.

With reference now to the drawings, and in particular, to FIGS. 1 through 4 thereof, the preferred embodiment of the new and improved removable perforated tray for coolers embodying the principles and concepts of the present invention and generally designated by the reference number 10 will be described.

Specifically, it will be noted in the various Figures that the device relates to a removable perforated tray for coolers for separating food items from melted ice to prevent the food items from sitting in water. In its broadest context, the device consists of a tray portion, four corner collars, and a central collar. Such components are individually configured and correlated with respect to each other so as to attain the desired objective.

The tray portion 12 has a generally rectangular configuration. The tray portion 12 is defined by opposed long side edges, opposed short end edges, and four corners. The tray portion 12 is constructed of a plurality of interconnecting horizontal and vertical ribs 14,16 whereby spaces 18 are created between interconnections of adjacent horizontal and vertical ribs 14,16. The tray portion 12 is dimensioned for being received within an interior of a cooler 20. The tray portion 12 will hold food items and ice thereon. When the ice melts, the water will seep through the spaces 18 and not cause the food items to become soggy.

The four corner collars 22 extend through large openings 24 of the tray portion 12 inwardly of the four corners thereof. The collar 22 is defined by open upper and lower ends 26,28. The open upper ends 26 have a peripheral flange 30 disposed thereon. A lower portion of the collars 22 are externally threaded for being engaged by an internally threaded washer 32 on an underside of the tray portion 12. The open lower ends 28 each have a support leg 34 extending outwardly thereof. The support legs 34 could be made so that it's length can be adjusted. The support legs 34 will serve to elevate the tray portion 12 above a closed lower end of the cooler 20 so that the tray portion 12 is not sitting in accumulated water generated by melting ice.

The central collar 36 extends through a large opening 24 in a central portion of the tray portion 12. The central collar 36 is defined by open upper and lower ends 26,28. The open upper end 26 has a peripheral flange 30 disposed thereon. A lower portion of the central collar 36 is externally threaded for being engaged by an internally threaded washer 32 on the underside of the tray portion 12. The open lower end 28 has a support leg 34 extending outwardly thereof. The central collar 36 with support leg 34 will elevate the center of the tray portion 12 within the cooler 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A removable perforated tray for coolers for separating food items from melted ice to prevent the food items from sitting in water comprising, in combination:

a tray portion having a generally rectangular configuration, the tray portion being defined by opposed long side edges, opposed short end edges, and four corners, the tray portion being constructed of a plurality of interconnecting horizontal and vertical ribs whereby spaces are created between interconnections of adjacent horizontal and vertical ribs, the tray portion being dimensioned for being received within an interior of a cooler;

four corner collars extending through large openings of the tray portion inwardly of the four corners thereof, the collar being defined by open upper and lower ends, the open upper ends having a peripheral flange disposed thereon, a lower portion of the collars being externally threaded and being engaged by an internally threaded washer on an underside of the tray portion, the open lower ends each having a support leg extending outwardly thereof;

a central collar extending through a large opening in a central portion of the tray portion, the central collar being defined by open upper and lower ends, the open upper end having a peripheral flange disposed thereon, a lower portion of the central collar being externally threaded and being engaged by an internally threaded washer on the underside of the tray portion, the open lower end having a support leg extending outwardly thereof.

2. A removable perforated tray for coolers for separating food items from melted ice to prevent the food items from sitting in water comprising, in combination:

a tray portion constructed of a plurality of interconnecting horizontal and vertical ribs whereby spaces are created between interconnections of adjacent horizontal and vertical ribs, the tray portion being dimensioned for being received within an interior of a cooler;

a plurality of peripheral collars extending through large openings of the tray portion inwardly of the periphery thereof, the collars each having a support leg extending outwardly thereof, said peripheral collars defined by open upper and lower ends, the open upper ends having a peripheral flange disposed thereon, a lower portion of the collars being externally threaded and being engaged by an internally threaded washer on an underside of the tray portion.

3. The removable perforated tray for coolers as set forth in claim 2 wherein the tray portion has a generally rectangular configuration and is defined by opposed long side edges, opposed short end edges, and four corners.

4. The removable perforated tray for coolers as set forth in claim 2 wherein the peripheral collars are defined by open upper and lower ends, the open upper ends having a peripheral flange disposed thereon, a lower portion of the collars being externally threaded for being engaged by an internally threaded washer on an underside of the tray portion.

5. The removable perforated tray for coolers as set forth in claim 2 and further including a central collar extending through a large opening in a central portion of the tray portion with a support leg extending outwardly thereof.

6. The removable perforated tray for coolers as set forth in claim 5 wherein the central collar is defined by open upper and lower ends, the open upper end having a peripheral flange disposed thereon, a lower portion of the central collar being externally threaded for being engaged by an internally threaded washer on the underside of the tray portion.

7. A removable perforated tray for coolers for separating food items from melted ice to prevent the food items from sitting in water comprising, in combination:

a tray portion constructed of a plurality of interconnecting horizontal and vertical ribs whereby spaces are created between interconnections of adjacent horizontal and vertical ribs, the tray portion being dimensioned for being received within an interior of a cooler;

a plurality of peripheral collars extending through large openings of the tray portion inwardly of the periphery thereof, the collars each having a support leg extending outwardly thereof; and a central collar extending through a large opening in a central portion of the tray portion with a support leg extending outwardly thereof, said collar defined by open upper and lower ends, the open upper end having a peripheral flange disposed thereon, a lower portion of the central collar being externally threaded and being engaged by an internally threaded washer on the underside of the tray portion.

* * * * *